US011564411B2

(12) United States Patent
Borges De Couraca et al.

(10) Patent No.: US 11,564,411 B2
(45) Date of Patent: Jan. 31, 2023

(54) SMOKING ARTICLE WITH DUAL HEAT-CONDUCTING ELEMENTS AND IMPROVED AIRFLOW

(71) Applicant: Philip Morris Products S.A., Neuchatel (CH)

(72) Inventors: Ana Carolina Borges De Couraca, Lausanne (CH); Cristina Apetrei Birza, Colombier (CH); David Kuchen, Domdidier (CH); Frederic Lavanchy, Grandson (CH); Laurent Edouard Poget, Bussigny (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 14/896,580

(22) PCT Filed: Aug. 12, 2014

(86) PCT No.: PCT/EP2014/067236

§ 371 (c)(1),
(2) Date: Dec. 7, 2015

(87) PCT Pub. No.: WO2015/022320

PCT Pub. Date: Feb. 19, 2015

(65) Prior Publication Data

US 2016/0143355 A1 May 26, 2016

(30) Foreign Application Priority Data

Aug. 13, 2013 (EP) ..... 13180307

(51) Int. Cl.
*A24F 42/60* (2020.01)
*A24D 1/22* (2020.01)

(52) U.S. Cl.
CPC ..... *A24D 1/22* (2020.01)

(58) Field of Classification Search
CPC .. A24F 47/00–008; A24F 15/00; A24F 15/01; A24F 15/015; A24F 40/00;
(Continued)

(56) References Cited

U.S. PATENT DOCUMENTS 2,104,329 A 1/1938 Levy
4,687,008 A * 8/1987 Houck, Jr. ..... A24D 3/061 131/191

(Continued)

FOREIGN PATENT DOCUMENTS

CN 88 1 00383 A 8/1988
CN 1039710 A 2/1990

(Continued)

OTHER PUBLICATIONS

CN1039710 (Machine Translation) [online], [retrieved on Jun. 14, 2018], retrieved from EPO Database (https://worldwide.espacenet.com/?locale=en_EP) (Year: 1990).*

(Continued)

*Primary Examiner* — Michael J Felton
*Assistant Examiner* — Yana B Krinker
(74) *Attorney, Agent, or Firm* — Oblon, McClelland, Maier & Neustadt, L.L.P.

(57) ABSTRACT

A smoking article is provided, including a combustible heat source having opposed front and rear faces; an aerosol-forming substrate downstream of the rear face; a first heat-conducting element circumscribing a rear portion of the combustible heat source and at least a front portion of the aerosol-forming substrate; a second heat-conducting element around at least a portion of the first heat-conducting element, wherein at least part of the second heat-conducting element is radially separated from the first heat-conducting element; and one or more first air inlets around a periphery of the aerosol-forming substrate.

18 Claims, 1 Drawing Sheet

(58) Field of Classification Search

Figure 1:
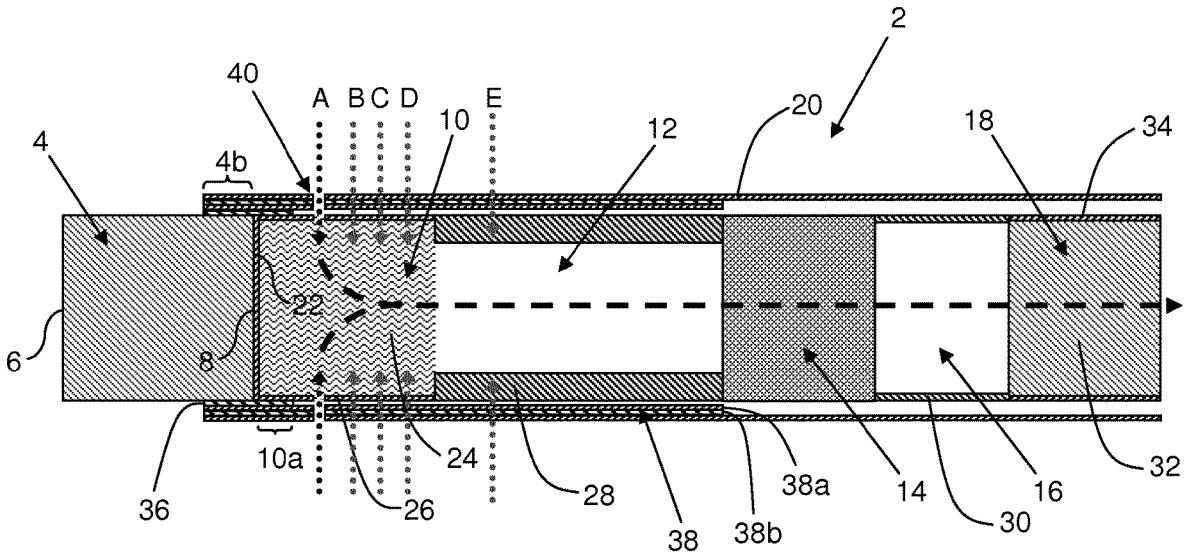

CPC ..... A24F 40/05; A24F 40/10; A24F 40/20; A24F 40/30; A24F 40/40; A24F 40/42; A24F 40/44; A24F 40/46; A24F 40/465; A24F 40/48; A24F 40/485; A24F 40/49; A24F 40/50; A24F 40/51; A24F 40/53; A24F 40/57; A24F 40/60; A24F 40/65; A24F 40/70; A24F 40/80; A24F 40/85; A24F 40/90; A24F 40/95; A24F 42/00; A24F 42/10; A24F 42/60; A24F 42/80; A24F 42/90; A24D 3/17; A24D 1/22; A24C 5/01

USPC ..... 131/270–273, 194; 128/202.21

See application file for complete search history.

(56) References Cited

U.S. PATENT DOCUMENTS

| | | | | |
|---|---|---|---|---|
| 4,714,082 | A | 12/1987 | Banerjee et al. | |
| 4,732,168 | A | 3/1988 | Resce et al. | |
| 4,771,795 | A | 9/1988 | White et al. | |
| 4,819,665 | A * | 4/1989 | Roberts | A24F 47/004 131/195 |
| 4,854,331 | A | 8/1989 | Banerjee et al. | |
| 4,928,714 | A | 5/1990 | Shannon | |
| 4,967,774 | A | 11/1990 | White | |
| 4,991,606 | A | 2/1991 | Serrano et al. | |
| 5,027,836 | A | 7/1991 | Shannon et al. | |
| 5,027,837 | A * | 7/1991 | Clearman | A24F 47/004 131/194 |
| 5,040,551 | A | 8/1991 | Schlatter et al. | |
| 5,067,499 | A | 11/1991 | Banerjee et al. | |
| 5,105,831 | A | 4/1992 | Banerjee et al. | |
| 5,119,834 | A | 6/1992 | Shannon et al. | |
| 5,247,947 | A | 9/1993 | Clearman et al. | |
| 7,503,330 | B2 | 3/2009 | Borschke et al. | |
| 2005/0066985 | A1 | 3/2005 | Borschke et al. | |
| 2009/0065011 | A1* | 3/2009 | Maeder | A24F 47/006 131/194 |
| 2010/0258139 | A1* | 10/2010 | Onishi | A24F 47/006 131/194 |
| 2011/0192408 | A1* | 8/2011 | Inagaki | A24F 47/004 131/194 |
| 2011/0271971 | A1 | 11/2011 | Conner et al. | |
| 2012/0067360 | A1 | 3/2012 | Conner et al. | |
| 2013/0133675 | A1* | 5/2013 | Shinozaki | A24F 47/008 131/329 |

FOREIGN PATENT DOCUMENTS

| | | | | |
|---|---|---|---|---|
| CN | 101778578 | A | 7/2010 | |
| DE | 199 35 706 | A1 | 2/2001 | |
| EP | 0 245 732 | | 11/1987 | |
| EP | 0 280 990 | A2 | 9/1988 | |
| EP | 0 280 990 | A3 | 9/1988 | |
| EP | 0 336 456 | | 10/1989 | |
| EP | 0 407 792 | A2 | 1/1991 | |
| EP | 0 407 792 | A3 | 1/1991 | |
| EP | 1 468 618 | A1 | 10/2004 | |
| JP | 61-92558 | | 5/1986 | |
| JP | 63-44876 | | 2/1988 | |
| JP | 63-164875 | A | 7/1988 | |
| JP | 63-192372 | A | 8/1988 | |
| JP | 64-71471 | | 3/1989 | |
| JP | 1-117775 | | 5/1989 | |
| JP | 3-19684 | | 1/1991 | |
| JP | 2919835 | | 4/1999 | |
| JP | 3012253 | B2 | 12/1999 | |
| JP | 3974898 | | 6/2007 | |
| JP | 2009-529871 | A | 8/2009 | |
| JP | 2009-529872 | | 8/2009 | |
| JP | 2010-535530 | A | 11/2010 | |
| JP | 2011-505823 | | 3/2011 | |
| JP | 2012-502658 | A | 2/2012 | |
| JP | 2012-513749 | | 6/2012 | |
| JP | 2013-523094 | | 6/2013 | |
| JP | 2013-524850 | A | 6/2013 | |
| SU | 1724000 | A3 | 3/1992 | |
| TW | 201134408 | A1 | 10/2011 | |
| WO | WO 2009/022232 | A2 | 2/2009 | |
| WO | WO 2009/074870 | A2 | 6/2009 | |
| WO | WO-2011117750 | A2 * | 9/2011 | A24F 47/008 |
| WO | WO-2012014490 | A1 * | 2/2012 | A24F 47/006 |
| WO | WO 2012/164077 | A1 | 12/2012 | |
| WO | WO 2013/043299 | A2 | 3/2013 | |
| WO | 2013/120854 | | 8/2013 | |
| WO | WO 2013/120849 | A1 | 8/2013 | |
| WO | WO 2013/120855 | A1 | 8/2013 | |
| WO | WO-2013120855 | A1 * | 8/2013 | A24F 47/006 |

OTHER PUBLICATIONS

International Search Report and Written Opinion of the International Searching Authority dated Mar. 5, 2015 in PCT/EP14/067236 Filed Aug. 12, 2014.

Combined Chinese Office Action and Search Report dated May 24, 2016 in Patent Application No. 201480033018.X (with English language translation).

Office Action dated Jun. 23, 2016 in Japanese Patent Application No. 2016-514447 (with English language translation).

Office Action dated Apr. 14, 2016 in Korean Patent Application No. 10-2015-7033709 (with English language translation).

Decision of Grant with English translation dated Nov. 21, 2016 in corresponding Japanese Patent Application No. 2016/514447, (7 pages).

Chinese Office Action with English translation dated Aug. 30, 2017 in corresponding Chinese Patent Application No. 201480033018.X, (15 pages)

Office Action dated Jul. 9, 2018 in corresponding Japanese Patent Application No. 2016-247643 (with English Translation), 7 pages.

Office Action dated Jun. 9, 2020 in corresponding Korean Patent Application No. 10-2017-7008163 (with English Translation), 4 pages.

Combined Russian Office Action and Search Report dated Jun. 3, 2021 in corresponding Russian Patent Application No. 2018109082 (with English translation), 13 pages.

* cited by examiner

SMOKING ARTICLE WITH DUAL HEAT-CONDUCTING ELEMENTS AND IMPROVED AIRFLOW

The present invention relates to a smoking article comprising a combustible heat source having opposed front and rear faces, an aerosol-forming substrate downstream of the rear face of the combustible heat source and dual heat-conducting elements around the smoking article.

A number of smoking articles in which tobacco is heated rather than combusted have been proposed in the art. One aim of such 'heated' smoking articles is to reduce known harmful smoke constituents of the type produced by the combustion and pyrolytic degradation of tobacco in conventional cigarettes. In one known type of heated smoking article, an aerosol is generated by the transfer of heat from a combustible heat source to an aerosol-forming substrate. The aerosol-forming substrate may be located within, around or downstream of the combustible heat source. During smoking, volatile compounds are released from the aerosol-forming substrate by heat transfer from the combustible heat source and entrained in air drawn through the smoking article. As the released compounds cool, they condense to form an aerosol that is inhaled by the user. Typically, air is drawn into such known heated smoking articles through one or more airflow channels provided through the combustible heat source and heat transfer from the combustible heat source to the aerosol-forming substrate occurs by forced convection and conduction.

For example, WO-A2-2009/022232 discloses a smoking article comprising a combustible heat source, an aerosol-forming substrate downstream of the combustible heat source, and a heat-conducting element around and in contact with a rear portion of the combustible heat source and an adjacent front portion of the aerosol-forming substrate.

The heat-conducting element in the smoking article of WO-A2-2009/022232 transfers heat generated during combustion of the combustible heat source to the aerosol-forming substrate by conduction. The heat drain exerted by the conductive heat transfer significantly lowers the temperature of the rear portion of the combustible heat source so that the temperature of the rear portion is retained significantly below its self-ignition temperature.

In smoking articles in which tobacco is heated rather than combusted, the temperature attained in the aerosol-forming substrate has a significant impact on the ability to generate a sensorially acceptable aerosol. It is typically desirable to maintain the temperature of the aerosol-forming substrate within a certain range in order to optimise the aerosol delivery to a user. In some cases, radiative heat losses from the outer surface of a heat-conducting element around and in contact with the combustible heat source and the aerosol-forming substrate may cause the temperature of the combustible heat source and the aerosol-forming substrate to drop outside of a desired range, thereby impacting the performance of the smoking article. If the temperature of the aerosol-forming substrate drops too low, for instance, it may adversely impact the consistency and the amount of aerosol delivered to a user.

In some heated smoking articles forced convective heat transfer to the aerosol-forming substrate is provided in addition to conductive heat transfer via a heat-conducting element. For example, in some known heated smoking articles one or more airflow channels are provided through the combustible heat source in order to provide forced convective heating of the aerosol-forming substrate. In such smoking articles, the aerosol-forming substrate is heated by a combination of conductive heating and forced convective heating.

In known heated smoking articles in which heat transfer from the combustible heat source to the aerosol-forming substrate occurs primarily by forced convection, the forced convective heat transfer and hence the temperature in the aerosol-forming substrate can vary considerably depending upon the puffing behaviour of a user. As a result, the composition and hence the sensory properties of the mainstream aerosol generated by such known heated smoking articles may disadvantageously be highly sensitive to a user's puffing regime.

In addition, in known heated smoking articles comprising one or more airflow channels along the combustible heat source, direct contact between air drawn through the one or more airflow channels and the combustible heat source during puffing by a user results in activation of combustion of the combustible heat source. Intense puffing regimes may therefore lead to sufficiently high forced convective heat transfer to cause spikes in the temperature of the aerosol-forming substrate, disadvantageously leading to pyrolysis and potentially even localised combustion of the aerosol-forming substrate. As used herein, the term 'spike' is used to describe a short-lived increase in the temperature of the aerosol-forming substrate. As a result, the levels of undesirable pyrolytic and combustion by-products in the mainstream aerosols generated by such known heated smoking articles may also disadvantageously vary significantly depending upon the particular puffing regime adopted by a user.

In other heated smoking articles no airflow channels are provided through the combustible heat source. In such heated smoking articles heating of the aerosol-forming substrate is achieved primarily by conductive heat transfer via a heat-conducting element. In heated smoking articles where the aerosol-forming substrate is heated primarily by conductive heat transfer, the temperature of the aerosol-forming substrate can become more sensitive to changes in the temperature of the heat-conducting element. This means that any cooling of the heat-conducting element due to radiative heat loss in such heated smoking articles may have a greater impact on the aerosol generation than in heated smoking articles where the aerosol-forming substrate is also heated by forced convective heat transfer.

EP-A2-0 336 456 discloses smoking articles comprising a combustible fuel element and a physically separate aerosol-generating means in a conductive heat exchange relationship with the fuel element. In the embodiment shown in FIG. 2 the combustible fuel element 24 is connected to aerosol generating means 12 by a heat conductive rod 26 and a foil lined paper tube 14, which leads to the mouth end 15 of the smoking article. The aerosol generating means 12 comprises a carbonaceous substrate 28 impregnated with one or more aerosol forming materials. A void space 30 is included between the fuel element 24 and the carbonaceous substrate 28 of the aerosol generating means 12. The portion of the foil lined tube 14 surrounding the void space 30 includes a plurality of peripheral holes 32 which permit air to enter the void space 30. In this embodiment the heat conductive rod 26 is inserted into the body of the combustible fuel element 24 and the carbonaceous substrate 28 of the aerosol generating means 12 and there are no air inlets in the portion of the foil lined tube 14 surrounding the carbonaceous substrate 28 of the aerosol generating means 12.

It is known to include additives in the combustible heat sources of heated smoking articles in order to improve the ignition and combustion properties of the combustible heat sources. However, the inclusion of ignition and combustion additives can give rise to decomposition and reaction products, which may disadvantageously enter air drawn through such known heated smoking articles during use thereof.

To facilitate aerosol formation, the aerosol-forming substrates of heated smoking articles typically comprise a polyhydric alcohol, such as glycerine, or other known aerosol-formers. During storage and smoking, such aerosol-formers may migrate from the aerosol-forming substrates of known heated smoking articles to the combustible heat sources thereof. Migration of aerosol-formers to the combustible heat sources of known heated smoking articles can disadvantageously lead to decomposition of the aerosol-formers, particularly during smoking of the heated smoking articles.

It would be desirable to provide a heated smoking article including a combustible heat source having opposed front and rear faces and an aerosol-forming substrate downstream of the rear face of the combustible heat source which provides improved smoking performance. In particular, it would be desirable to provide a heated smoking article in which there is improved control of the heating of the aerosol-forming substrate in order to help maintain the temperature of the aerosol-forming substrate within a desired temperature range during smoking.

According to the invention there is provided a smoking article comprising: a combustible heat source having opposed front and rear faces; an aerosol-forming substrate downstream of the rear face of the combustible heat source; a first heat-conducting element circumscribing a rear portion of the combustible heat source and at least a front portion of the aerosol-forming substrate; a second heat-conducting element around at least a portion of the first heat-conducting element, wherein at least part of the second heat-conducting element is radially separated from the first heat-conducting element; and one or more first air inlets around the periphery of the aerosol-forming substrate.

As used herein, the terms 'distal', 'upstream' and 'front', and 'proximal', 'downstream' and 'rear', are used to describe the relative positions of components, or portions of components, of the smoking article in relation to the direction in which a user draws on the smoking article during use thereof. Smoking articles according to the invention comprise a proximal end through which, in use, an aerosol exits the smoking article for delivery to a user. The proximal end of the smoking article may also be referred to as the mouth end. In use, a user draws on the proximal end of the smoking article in order to inhale an aerosol generated by the smoking article.

The combustible heat source is located at or proximate to the distal end. The mouth end is downstream of the distal end. The proximal end may also be referred to as the downstream end of the smoking article and the distal end may also be referred to as upstream end of the smoking article. Components, or portions of components, of smoking articles according to the invention may be described as being upstream or downstream of one another based on their relative positions between the proximal end and the distal end of the smoking article.

The front face of the combustible heat source is at the upstream end of the combustible heat source. The upstream end of the combustible heat source is the end of the combustible heat source furthest from the proximal end of the smoking article. The rear face of the combustible heat source is at the downstream end of the combustible heat source. The downstream end of the combustible heat source is the end of the combustible heat source closest to the proximal end of the smoking article.

As used herein, the term 'length' is used to describe the maximum dimension in the longitudinal direction of the smoking article. That is, the maximum dimension in the direction between the proximal end and the opposed distal end of the smoking article.

As used herein, the term 'aerosol-forming substrate' is used to describe a substrate capable of releasing upon heating volatile compounds, which can form an aerosol. The aerosols generated from aerosol-forming substrates of smoking articles according to the invention may be visible or invisible and may include vapours (for example, fine particles of substances, which are in a gaseous state, that are ordinarily liquid or solid at room temperature) as well as gases and liquid droplets of condensed vapours.

The aerosol-forming substrate may be in the form of a plug or segment comprising a material capable of releasing upon heating volatile compounds, which can form an aerosol, circumscribed by a wrapper. Where an aerosol-forming substrate is in the form of such a plug or segment, the entire plug or segment including the wrapper is considered to be the aerosol-forming substrate.

As used herein, the term 'air inlet' is used to describe a hole, slit, slot or other aperture through which air may be drawn into the smoking article.

The first heat-conducting element and the second heat-conducting element comprise heat-conductive material.

As used herein, the term "radially separated" is used to indicate that at least a part of the heat-conductive material of the second heat-conducting element is spaced apart from the heat-conductive material of the first heat-conducting element in a radial direction, such that there is no direct contact between at least a part of the heat-conductive material of the second heat-conducting element and the heat-conductive material of the first heat-conducting element.

As used herein, the term 'radial' is used to describe the direction perpendicular to the direction between the proximal end and the opposed distal end of the smoking article.

As used herein, the term 'direct contact' is used to mean contact between two components without any intermediate material, such that the surfaces of the components are touching each other.

Smoking article according to the invention comprise a first heat-conducting element circumscribing a rear portion of the combustible heat source and at least a front portion of the aerosol-forming substrate and a second heat-conducting element around at least a portion of the first heat-conducting element.

In certain embodiments, the first heat-conducting element may be in direct contact with a rear portion of the combustible heat source and at least a front portion of the aerosol-forming substrate. In such embodiments, the rear portion of the combustible heat source is circumscribed by and is in direct contact with the first heat-conducting element and at least a front portion of the aerosol-forming substrate is circumscribed by and is in direct contact with the first heat-conducting element. In such embodiments, the first heat-conducting element provides a thermal link between the combustible heat source and aerosol-forming substrate of smoking articles according to the invention.

In other embodiments, the first heat-conducting element may be spaced apart from one or both of the rear portion of the combustible heat source and the aerosol-forming substrate in a radial direction, such that there is no direct contact between the first heat-conducting element and one or both of the rear portion of the combustible heat source and the aerosol-forming substrate.

The second heat-conducting element overlies at least a portion of the first heat-conducting element. There is radial separation between the first heat-conducting element and the second heat-conducting element at one or more positions along the smoking article.

Preferably, all or substantially all of the second heat-conducting element is radially separated from the first heat-conducting element, such that there is substantially no direct contact between the first heat-conducting element and the second heat-conducting element. This advantageously limits or inhibits conductive heat transfer from the first heat-conducting element to the second heat-conducting element.

Preferably, conductive heat transfer from the first heat-conducting element to the second heat-conducting element is substantially reduced. This advantageously results in the second heat-conducting element retaining a lower temperature than the first heat-conducting element. In preferred embodiments, radiative heat losses from outer surfaces of the smoking article are substantially reduced compared to a smoking article that does not comprise a second heat-conducting element around at least a portion of the first heat-conducting element.

The second heat-conducting element advantageously reduces heat losses from the first heat-conducting element. The second heat-conducting element comprises heat-conductive material that will increase in temperature during smoking of the smoking article, as heat is generated by the combustible heat source. The increased temperature of the second heat-conducting element reduces the temperature differential between the first heat-conducting element and overlying components of the smoking article, such that heat losses from the first heat-conducting element can be reduced.

By reducing heat losses from the first heat-conducting element, the second heat-conducting element advantageously helps to better maintain the temperature of the first heat-conducting element within a desired temperature range. The second heat-conducting element advantageously helps to more effectively use the heat from the combustible heat source to heat the aerosol-forming substrate to within the desired temperature range. In a further advantage, the second heat-conducting element helps maintain the temperature of the aerosol-forming substrate at a higher level. The second heat-conducting element in turn improves the generation of aerosol from the aerosol-forming substrate. Advantageously, the second heat-conducting element increases the overall delivery of aerosol to a user. In particular, it can be seen that where the aerosol-forming substrate comprises nicotine, the nicotine delivery to a user can be significantly improved through the inclusion of a second heat-conducting element.

In addition, inclusion of a second heat-conducting element has been found to advantageously extend the smoking duration of the smoking article so that a greater number of puffs can be taken by a user.

In certain preferred embodiments, the second heat-conducting element conducts heat along the smoking article from the combustible heat source in the same way as the first heat-conducting element. In such embodiments, the second heat-conducting element may also improve the efficiency of conductive heat transfer from the combustible heat source to the aerosol-forming substrate and therefore the heating of the aerosol-forming substrate.

The improvement in conductive heat transfer achieved through the inclusion of a second heat-conducting element is particularly beneficial for smoking articles in which there is substantially no forced convective heat transfer.

The radial separation between the first heat-conducting element and second heat-conducting element is preferably achieved through the inclusion of one or more intermediate layers of material between the first heat-conducting element and the second heat-conducting element. The one or more intermediate layers of material may be provided over the entire area in which the second heat-conducting element overlies the first heat-conducting element. Alternatively, the one or more intermediate layers of material may be provided in only part or parts of this area. The one or more intermediate layers of material may in some cases extend beyond one or both of the first heat-conducting element and the second heat-conducting elements in one or both of the upstream direction and the downstream direction.

Preferably, the first heat-conducting element and the second heat-conducting element are radially separated by one or more layers of heat-insulative material. Suitable heat-insulative materials include, but are not limited to, paper, ceramics and metal oxides.

For example, in one preferred embodiment of the invention, the first heat-conducting element is covered by a paper wrapper that circumscribes the smoking article along at least a portion of its length. In such embodiments, the paper wrapper advantageously provides complete separation of the first heat-conducting element and the second heat-conducting element such that there is no direct contact between the first heat-conducting element and the second heat-conducting element.

In certain embodiments, the first heat-conducting element and the second heat-conducting element are radially separated by an inner wrapper or an outer wrapper that extends along all or just a part of the smoking article. In such embodiments, the inner wrapper or outer wrapper is wrapped around the smoking article over the first heat-conducting element and the second heat-conducting element is then provided over at least a portion of the inner wrapper or outer wrapper.

Preferably, the second heat-conducting element is provided on the outside of the smoking article, such that the second heat-conducting element is visible on the exterior of the smoking article.

Alternatively, an outer wrapper that extends along all or just a part of the smoking article may be provided over the second heat-conducting element, such that the second heat-conducting element is not visible or only partly visible on the exterior of the smoking article.

The provision of the second heat-conducting element over a wrapper of the smoking article may provide benefits in relation to the appearance of smoking articles according to the invention, in particular during and after smoking thereof. In certain cases, some discolouration of the wrapper in the region of the combustible heat source may be observed when the wrapper is exposed to heat from the combustible heat source. The wrapper may additionally be discoloured as a result of the migration of volatile compounds from the aerosol-forming substrate into the wrapper around and downstream of the aerosol-forming substrate. In certain embodiments, the second heat-conducting element of smoking articles according to the invention may be provided over the wrapper around at least a rear part of the combustible heat source and at least a front part of the aerosol-forming substrate so that discolouration of the wrapper is covered and no longer or less visible. In certain embodiments, the second heat-conducting element may extend around the entire length of the aerosol-forming substrate. In certain preferred embodiments, the second heat-conducting element may extend downstream beyond the aerosol-forming substrate. The initial appearance of the smoking article can therefore be retained during smoking.

Alternatively or in addition to one or more layers of heat-insulative material between the first heat-conducting element and second heat-conducting element, at least part of the second heat-conducting element may be radially separated from the first heat-conducting element by an air gap. An air gap may be provided through the inclusion of one or more spacer elements between the first heat-conducting element and the second heat-conducting element to maintain a defined separation between at least part of the second heat-conducting element and the first heat-conducting element. The one or more spacer elements may be, for example, one or more strips of paper wrapped radially around the first heat-conducting element.

Preferably, the first heat-conducting element and the second heat-conducting element are radially separated from each other by at least 20 microns, more preferably by at least 50 microns. In certain embodiments, the first heat-conducting element and the second heat-conducting element are radially separated from each other by at least 75 microns or more or by at least 100 microns or more.

Where one or more layers of heat-insulative material are provided between the first heat-conducting element and the second heat-conducting element, as described above, the radial separation of the first heat-conducting element and the second heat-conducting element will be determined by the thickness of the one or more layers of heat-insulative material.

As described above, the first heat-conducting element of smoking articles according to the invention is preferably in direct contact with a rear portion of the combustible heat source and at least a front portion of the aerosol-forming substrate. The first heat-conducting element is preferably combustion resistant. In certain embodiments, the first heat-conducting element is oxygen restricting. In such embodiments, the first heat-conducting element inhibits or resists the passage of oxygen through the first heat-conducting element to the combustible heat source.

In particularly preferred embodiments, the first heat-conducting element forms a continuous sleeve that tightly circumscribes a rear portion of the combustible heat source and at least a front portion of the aerosol-forming substrate.

In certain embodiments, the first heat-conducting element provides a substantially airtight connection between the combustible heat source and the aerosol-forming substrate. This may advantageously prevent or inhibit combustion gases from the combustible heat source being readily drawn into the aerosol-forming substrate through its periphery. Such a connection may also advantageously minimise or substantially avoid forced convective heat transfer from the combustible heat source to the aerosol-forming substrate by air drawn along the peripheries of the combustible heat source and the aerosol-forming substrate.

Preferably, the physical integrity of the first heat-conducting element is maintained at temperatures achieved by the combustible heat source during ignition and combustion. In embodiments in which the first heat-conducting element provides a substantially airtight connection between the combustible heat source and the aerosol-forming substrate, this advantageously helps to maintain the airtight connection during use of the smoking article.

The first heat-conducting element may comprise any suitable heat-conductive material or combination of materials with an appropriate thermal conductivity.

Preferably, the first heat-conducting element comprises one or more heat-conductive materials having a bulk thermal conductivity of between about 10 W per metre Kelvin (W/(m·K)) and about 500 W per metre Kelvin (W/(m·K)), more preferably between about 15 W per metre Kelvin (W/(m·K)) and about 400 W per metre Kelvin (W/(m·K)), at 23° C. and a relative humidity of 50% as measured using the modified transient plane source (MTPS) method. Suitable heat-conductive materials include, but are not limited to: metal foil wrappers such as, for example, aluminium foil wrappers, steel wrappers, iron foil wrappers and copper foil wrappers; and metal alloy foil wrappers.

The first heat-conducting element may be formed of a single layer of heat-conductive material. Alternatively, the first heat-conducting element may be formed of a multilayer or laminate material comprising at least one layer of heat-conductive material in combination with one or more other heat-conducting layers or non-heat-conducting layers. In such embodiments, the at least one layer of heat-conductive material may comprise any of the heat-conductive materials listed above.

In certain embodiments, the first heat-conducting element may be formed of a laminate material comprising at least one layer of heat-conductive material and at least one layer of heat-insulative material. In such embodiments, the inner layer of the first heat-conducting element facing the rear portion of the combustible heat and at least a front portion of the aerosol-forming substrate may be a layer of heat-conductive material and the outer layer of the first heat-conducting element facing the second heat-conducting element may be a layer of heat-insulative material. In this way, the outer layer of heat-insulative material provides the required radial separation between the heat-conductive material of the second heat-conducting element and the heat-conductive material of the first heat-conducting element.

One example of a particularly suitable laminate material for forming the first heat-conducting element is a double layer laminate material comprising an outer layer of paper and an inner layer of aluminium.

Preferably the thickness of the first heat-conducting element is between about 5 microns and about 50 microns, more preferably between about 10 microns and about 30 microns and most preferably about 20 microns. In certain particularly preferred embodiments, the first heat-conducting element comprises aluminium foil having a thickness of about 20 microns.

Preferably, the rear portion of the combustible heat source surrounded by the first heat-conducting element is between about 2 mm and about 8 mm in length, more preferably between about 3 mm and about 5 mm in length.

Preferably, the front portion of the combustible heat source not surrounded by the first heat-conducting element is between about 4 mm and about 15 mm in length, more preferably between about 5 mm and about 8 mm in length.

In certain embodiments, the entire length of the aerosol-forming substrate may be surrounded by the first heat-conducting element.

In other embodiments, the first heat-conducting element may surround only a front portion of the aerosol-forming substrate. In such embodiments, the aerosol-forming substrate extends downstream beyond the first heat-conducting element.

In embodiments in which the first heat-conducting element surrounds only a front portion of the aerosol-forming substrate, the aerosol-forming substrate preferably extends at least about 3 mm downstream beyond the first heat-conducting element. More preferably, the aerosol-forming substrate extends between about 3 mm and about 10 mm downstream beyond the first heat-conducting element. However, the aerosol-forming substrate may extend less than 3 mm downstream beyond the first heat-conducting element.

In such embodiments, the front portion of the aerosol-forming substrate surrounded by the first heat-conducting element is preferably between about 1 mm and about 10 mm in length, more preferably between about 2 mm and about 8 mm in length, most preferably between about 2 mm and about 6 mm in length.

The second heat-conducting element is provided around at least a portion of the first heat-conducting element.

The second heat-conducting element may extend around all or a part of the circumference of the smoking article. Preferably, the second heat-conducting element forms a continuous sleeve that circumscribes at least a portion of the first heat-conducting element.

The second heat-conducting element may comprise any suitable heat-conductive material or combination of materials with an appropriate thermal conductivity.

Preferably, the second heat-conducting element comprises one or more heat-conductive materials having a bulk thermal conductivity of between about 10 W per metre Kelvin (W/(m·K)) and about 500 W per metre Kelvin (W/(m·K)), more preferably between about 15 W per metre Kelvin (W/(m·K)) and about 400 W per metre Kelvin (W/(m·K)), at 23° C. and a relative humidity of 50% as measured using the modified transient plane source (MTPS) method. Suitable heat-conductive materials include, but are not limited to: metal foil wrappers such as, for example, aluminium foil wrappers, steel wrappers, iron foil wrappers and copper foil wrappers; and metal alloy foil wrappers.

The first heat-conducting element and the second heat-conducting element may comprise the same or different heat-conductive material or materials.

In certain preferred embodiments, the first heat-conducting element and the second heat-conducting element comprise the same heat-conductive material. In certain preferred embodiments, the first heat-conducting element and the second heat-conducting element comprise aluminium foil.

Preferably, the second heat-conducting element comprises one or more heat reflective materials, such as aluminium or steel. In such embodiments, in use, the second heat-conducting element advantageously reflects heat radiating from the first heat-conducting element back towards the first heat-conducting element. This further reduces heat losses from the first heat-conducting element so that the temperature of the first heat-conducting element can be better controlled and the combustible heat source can be maintained at a higher temperature.

As used herein the term 'heat reflective material' refers to a material that has a relatively high heat reflectivity and a relatively low heat emissivity such that the material reflects a greater proportion of incident radiation from its surface than it emits. Preferably, the material reflects more than 50% of incident radiation, more preferably more than 70% of incident radiation and most preferably more than 75% of incident radiation.

In embodiments in which the second heat-conducting element comprises a heat reflective material, preferably all or substantially all of the second heat-conducting element is radially separated from the first heat-conducting element in order to facilitate the reflection of heat by the second heat-conducting element towards the first heat-conducting element.

The reflectivity of the second heat-conducting element may be improved by providing the second heat-conducting element with a shiny inner surface, wherein the inner surface is the surface of the second heat-conducting element that faces the outer surface of the first heat-conducting element.

The second heat-conducting element may be formed of a single layer of heat-conductive material. Alternatively, the second heat-conducting element may be formed of a multilayer or laminate material comprising at least one layer of heat-conductive material in combination with one or more other heat-conducting layers or non-heat-conducting layers. In such embodiments, the at least one layer of heat-conductive material may comprise any of the heat-conductive materials listed above.

In certain preferred embodiments, the second heat-conducting element may be formed of a laminate material comprising at least one layer of heat-conductive material and at least one layer of heat-insulative material. In such embodiments, the inner layer of the second heat-conducting element facing the first heat-conducting element may be a layer of heat-insulative material. In this way, the inner layer of heat-insulative material provides the required radial separation between the heat-conductive material of the second heat-conducting element and the heat-conductive material of the first heat-conducting element.

In certain preferred embodiments, the second heat-conducting element comprises a single layer of heat-conductive material.

In certain preferred embodiments, the second heat-conducting element is a laminate material comprising a single layer of heatconductive material and one or more layers of heat-insulative material. In certain particularly preferred embodiments, the second heat-conducting element is a laminate material comprising a single layer of heat conductive material and a single layer of heat-insulative material. Preferably, the second heat-conducting element is a laminate material comprising a single outer layer of heat-conductive material and a single inner layer of heat-insulative material.

One example of a particularly suitable laminate material for forming the second heat-conducting element is a double layer laminate material comprising an outer layer of aluminium and an inner layer of paper.

The use of a second heat-conducting element comprising a laminate material may additionally be beneficial during the production of the smoking articles according to the invention, since the at least one heat-insulating layer may provide added strength and rigidity. This enables the laminate material to be processed more easily, with a reduced risk of collapse or breakage of the at least one heat-conducting layer, which may be relatively thin and fragile.

The thickness of the second heat-conducting element may be substantially the same as the thickness of the first heat-conducting element. Alternatively, the first heat-conducting element and the second heat-conducting element may have different thicknesses to each other.

Preferably the thickness of the second heat-conducting element is between about 5 microns and about 100 microns, more preferably between about 5 microns and about 80 microns.

Preferably the second heat-conducting element comprises one or more layers of heat-conductive material having a thickness of between about 2 microns and about 50 microns, more preferably between about 4 microns and about 30 microns.

In certain embodiments, the second heat-conducting element may comprise aluminium foil having a thickness of about 20 microns.

In certain preferred embodiments, the second heat-conducting element may comprise a laminate material comprising an outer layer of aluminium having a thickness of between about 5 microns and about 6 microns and an inner layer of paper.

The position and extent of the second heat-conducting element relative to the first heat-conducting element, the combustible heat source and the aerosol-forming substrate may be adjusted in order to control heating of the aerosol-forming substrate during smoking.

The second heat-conducting element may be positioned around at least a portion of the aerosol-forming substrate. Alternatively or in addition, the second heat-conducting element may be positioned around at least a portion of the combustible heat source.

Preferably, the second heat-conducting element is positioned around at least a portion of the aerosol-forming substrate and at least a portion of the combustible heat source, in a similar way to the first heat-conducting element.

The extent of the second heat-conducting element relative to the first heat-conducting element in the upstream direction and the downstream direction may be adjusted depending on the desired performance of the smoking article.

The second heat-conducting element overlies at least a portion of the first heat-conducting element.

The second heat-conducting element may circumscribe substantially the same area of the combustible heat source and the aerosol-forming substrate as the first heat-conducting element, so that the first heat-conducting element and the heat-conducting element extend along the same length of the smoking article. In such embodiments, the second heat-conducting element preferably directly overlies the first heat-conducting element and fully covers the first heat-conducting element.

In alternative embodiments, the second heat-conducting element overlies at least a portion of the first heat-conducting element, but may extend beyond the first heat-conducting element in the upstream direction, or the downstream direction, or both the upstream direction and the downstream direction.

Alternatively or, where appropriate, in addition, the first heat-conducting element may extend beyond the second heat-conducting element in the upstream direction, or the downstream direction, or both the upstream direction and the downstream direction.

Preferably, the second heat-conducting element does not extend substantially beyond the first heat-conducting element in the upstream direction. The second heat-conducting element may extend to approximately the same position on the combustible heat source as the first heat-conducting element in the upstream direction, such that the upstream ends of the first heat-conducting element and the second heat-conducting element are substantially aligned over the combustible heat source. Alternatively, the first heat-conducting element may extend beyond the second heat-conducting element in the upstream direction. This arrangement may reduce the temperature of the combustible heat source.

Preferably, the second heat-conducting element extends to at least the same position as the first heat-conducting element in the downstream direction. The second heat-conducting element may extend to approximately the same position on the aerosol-forming substrate as the first heat-conducting element in the downstream direction, such that the downstream ends of the first heat-conducting element and the second heat-conducting element are substantially aligned over the aerosol-forming substrate. Alternatively, the second heat-conducting element may extend beyond the first heat-conducting element in the downstream direction so that the second heat-conducting element circumscribes a larger area of the aerosol-forming substrate than the first heat-conducting element.

For example, the second heat-conducting element may extend at least 1 mm beyond the first heat-conducting element in the downstream direction, or at least 2 mm beyond the first heat-conducting element in the downstream direction.

In certain preferred embodiments, the second heat-conducting element overlies at least a portion of the first heat-conducting element and circumscribes the entire length of the aerosol-forming substrate. In certain embodiments, the second heat-conducting element overlies at least a portion of the first heat-conducting element and extends beyond the aerosol-forming substrate in the downstream direction.

In other embodiments, the second heat-conducting element overlies at least a portion of the first heat-conducting element, but circumscribes only a front portion of the aerosol-forming substrate. In such embodiments, the aerosol-forming substrate extends beyond the second heat-conducting element in the downstream direction.

It has surprisingly been found that the extent of the second heat-conducting element relative to the first heat-conducting element over the aerosol-forming substrate has a significant impact on the smoking performance of the smoking article. The coverage of the second heat-conducting element over the aerosol-forming substrate can therefore be adjusted in order to adjust the aerosol delivery profile of the smoking article.

In particular, it has been found that when the second heat-conducting element overlies at least a portion of the first heat-conducting element and extends beyond the first heat-conducting element in a downstream direction, a more consistent puff-by-puff aerosol delivery is provided during smoking. In particular, the aerosol delivery during middle puffs is found to be reduced, thereby reducing the smoking intensity during these puffs in order to bring it more into line with the intensity during initial puffs and final puffs. It has also been found that the smoking duration is further increased.

When the second heat-conducting element overlies at least a portion of the first heat-conducting element and extends downstream beyond the first heat-conducting element over the aerosol-forming substrate, a larger area of the aerosol-forming substrate is covered by the second heat-conducting element. Heat is thereby dispersed through a greater volume of the aerosol-forming substrate, such that there is less of a temperature differential between different portions of the aerosol-forming substrate. This results in a decrease in the temperature of the front portion of the aerosol-forming substrate and an increase in the temperature of the rear portion of the aerosol-forming substrate. It is believed that this is responsible for the observed effect on the puff-by-puff aerosol delivery.

As used herein, the term "puff-by-puff aerosol delivery" refers to the profile of the amount of aerosol delivered to a user during each puff. For a typical heated smoking article, the puff-by-puff aerosol delivery profile is in the form of a bell-shaped curve, with the amount of aerosol delivered to a user increasing towards the middle puffs, before decreasing again towards the final puffs. The puff-by-puff aerosol delivery may be adjusted so that the actual amount of aerosol delivered to a user in each puff is modified. Alternatively or in addition, the relative amounts delivered of aerosol delivered to a user in each puff are changed, so that the shape of the puff-by-puff aerosol delivery profile is changed.

Smoking articles according to the invention comprise one or more first air inlets around the periphery of the aerosol-forming substrate.

It has surprisingly been found that the inclusion of one or more first air inlets around the periphery of the aerosol-forming substrate in combination with a second heat-conducting element advantageously increases the aerosol delivery of the smoking article.

In use, cool air is drawn into the aerosol-forming substrate of the smoking article through the first air inlets. The air drawn into the aerosol-forming substrate through the first air inlets passes downstream through the smoking article from the aerosol-forming substrate and exits the smoking article through the proximal end thereof.

During puffing by a user, the cool air drawn through the one or more first air inlets around the periphery of the aerosol-forming substrate advantageously reduces the temperature of the aerosol-forming substrate of smoking articles according to the invention. This advantageously substantially prevents or inhibits spikes in the temperature of the aerosol-forming substrate of smoking articles according to the invention during puffing by a user.

As used herein, the term 'cool air' is used to describe ambient air that is not significantly heated by the combustible heat source upon puffing by a user.

By preventing or inhibiting spikes in the temperature of the aerosol-forming substrate, the inclusion of one or more first air inlets around the periphery of the aerosol-forming substrate, advantageously helps to avoid or reduce combustion or pyrolysis of the aerosol-forming substrate of smoking articles according to the invention under intense puffing regimes. In addition, the inclusion of one or more first air inlets around the periphery of the aerosol-forming substrate advantageously helps to minimise or reduce the impact of a user's puffing regime on the composition of the mainstream aerosol of smoking articles according to the invention.

The number, shape, size and location of the first air inlets may be appropriately adjusted to achieve a good smoking performance.

In certain preferred embodiments, the one or more first air inlets are located proximate to the downstream end of the aerosol-forming substrate.

In certain embodiments, the aerosol-forming substrate may abut the rear face of the combustible heat source.

As used herein, the term 'abut' is used to describe the aerosol-forming substrate being in direct contact with the rear face of the combustible heat source or a non-combustible substantially air impermeable barrier coating provided on the rear face of the combustible heat source.

In other embodiments, the aerosol-forming substrate may be spaced apart from the rear face of the combustible heat source. That is, there may be a space or gap between the aerosol-forming substrate and the rear face of the combustible heat source.

In such embodiments, smoking articles according to the invention may further comprise one or more second air inlets between the rear face of the combustible heat source and the aerosol-forming substrate. In use, cool air is drawn into the space between the combustible heat source and the aerosol-forming substrate through the second air inlets. The air drawn into the space between the combustible heat source and the aerosol-forming substrate through the second air inlets passes downstream through the smoking article from the space between the combustible heat source and the aerosol-forming substrate and exits the smoking article through the proximal end thereof.

During puffing by a user, cool air drawn through the one or more second inlets between the rear face of the combustible heat source and the aerosol-forming substrate may also advantageously reduce the temperature of the aerosol-forming substrate of smoking articles according to the invention. This may advantageously substantially prevent or inhibit spikes in the temperature of the aerosol-forming substrate of smoking articles according to the invention during puffing by a user.

Alternatively or in addition, smoking articles according to the invention may further comprise one or more third air inlets downstream of the aerosol-forming substrate.

It will be appreciated that smoking articles according to the invention may comprise one or more first air inlets around the periphery of the aerosol-forming substrate and one or more second air inlets between the rear face of the combustible heat source and the aerosol-forming substrate, or one or more first air inlets around the periphery of the aerosol-forming substrate and one or more third air inlets downstream of the aerosol-forming substrate, or one or more first air inlets around the periphery of the aerosol-forming substrate and one or more second air inlets between the rear face of the combustible heat source and the aerosol-forming substrate and one or more third air inlets downstream of the aerosol-forming substrate.

Smoking articles according to the invention may further comprise a non-combustible substantially air impermeable first barrier between the rear face of the combustible heat source and the aerosol-forming substrate.

As used herein, the term 'non-combustible' is used to describe a barrier that is substantially non-combustible at temperatures reached by the combustible heat source during combustion and ignition thereof.

The first barrier may abut one or both of the rear face of the combustible heat source and the aerosol-forming substrate. Alternatively, the first barrier may be spaced apart from one or both of the rear face of the combustible heat source and the aerosol-forming substrate.

The first barrier may be adhered or otherwise affixed to one or both of the rear face of the combustible heat source and the aerosol-forming substrate.

In certain preferred embodiments, the first barrier comprises a non-combustible substantially air impermeable first barrier coating provided on the rear face of the combustible heat source. In such embodiments, preferably the first barrier comprises a first barrier coating provided on at least substantially the entire rear face of the combustible heat source. More preferably, the first barrier comprises a first barrier coating provided on the entire rear face of the combustible heat source.

As used herein, the term 'coating' is used to describe a layer of material that covers and is adhered to the combustible heat source.

The first barrier may advantageously limit the temperature to which the aerosol-forming substrate is exposed during ignition and combustion of the combustible heat source, and so help to avoid or reduce thermal degradation or combustion of the aerosol-forming substrate during use of the smoking article. This is particularly advantageous where the combustible heat source comprises one or more additives to aid ignition of the combustible heat source.

Inclusion of a non-combustible substantially air impermeable first barrier between the rear face of the combustible heat source and the aerosol-forming substrate may also advantageously substantially prevent or inhibit migration of components of the aerosol-forming substrate of smoking articles according to the invention to the combustible heat source during storage of the smoking articles.

Alternatively or in addition, inclusion of a non-combustible substantially air impermeable first barrier between the rear face of the combustible heat source and the aerosol-forming substrate may advantageously substantially prevent or inhibit migration of components of the aerosol-forming substrate of smoking articles according to the invention to the combustible heat source during use of the smoking articles.

Inclusion of a non-combustible substantially air impermeable first barrier between the rear face of the combustible heat source and the aerosol-forming substrate may be particularly advantageous where the aerosol-forming substrate comprises at least one aerosol-former.

In such embodiments, inclusion of a non-combustible substantially air impermeable first barrier between the rear face of the combustible heat source and the aerosol-forming substrate may advantageously prevent or inhibit migration of the at least one aerosol-former from the aerosol-forming substrate to the combustible heat source during storage and use of the smoking article. Decomposition of the at least one aerosol-former during use of the smoking articles may thus be advantageously substantially avoided or reduced.

Depending upon the desired characteristics and performance of the smoking article, the first barrier may have a low thermal conductivity or a high thermal conductivity. In certain embodiments, the first barrier may be formed from material having a bulk thermal conductivity of between about 0.1 W per metre Kelvin (W/(m·K)) and about 200 W per metre Kelvin (W/(m·K)), at 23° C. and a relative humidity of 50% as measured using the modified transient plane source (MTPS) method.

The thickness of the first barrier may be appropriately adjusted to achieve good smoking performance. In certain embodiments, the first barrier may have a thickness of between about 10 microns and about 500 microns.

The first barrier may be formed from one or more suitable materials that are substantially thermally stable and non-combustible at temperatures achieved by the combustible heat source during ignition and combustion. Suitable materials are known in the art and include, but are not limited to, clays (such as, for example, bentonite and kaolinite), glasses, minerals, ceramic materials, resins, metals and combinations thereof.

Preferred materials from which the first barrier may be formed include clays and glasses. More preferred materials from which the first barrier may be formed include copper, aluminium, stainless steel, alloys, alumina ($Al_2O_3$), resins, and mineral glues.

In certain preferred embodiments, the first barrier comprises a clay coating comprising a 50/50 mixture of bentonite and kaolinite provided on the rear face of the combustible heat source. In other preferred embodiments, the first barrier comprises a glass coating, more preferably a sintered glass coating, provided on the rear face of the combustible heat source.

In certain particularly preferred embodiments, the first barrier comprises an aluminium coating provided on the rear face of the combustible heat source.

Preferably, the first barrier has a thickness of at least about 10 microns.

Due to the slight permeability of clays to air, in embodiments where the first barrier comprises a clay coating provided on the rear face of the combustible heat source, the clay coating more preferably has a thickness of at least about 50 microns, and most preferably of between about 50 microns and about 350 microns.

In embodiments where the first barrier is formed from one or more materials that are more impervious to air, such as aluminium, the first barrier may be thinner, and generally will preferably have a thickness of less than about 100 microns, and more preferably of about 20 microns.

In embodiments where the first barrier comprises a glass coating provided on the rear face of the combustible heat source, the glass coating preferably has a thickness of less than about 200 microns.

The thickness of the first barrier may be measured using a microscope, a scanning electron microscope (SEM) or any other suitable measurement methods known in the art.

Where the first barrier comprises a first barrier coating provided on the rear face of the combustible heat source, the first barrier coating may be applied to cover and adhere to the rear face of the combustible heat source by any suitable methods known in the art including, but not limited to, spray-coating, vapour deposition, dipping, material transfer (for example, brushing or gluing), electrostatic deposition or any combination thereof.

For example, the first barrier coating may be made by pre-forming a barrier in the approximate size and shape of the rear face of the combustible heat source, and applying it to the rear face of the combustible heat source to cover and adhere to at least substantially the entire rear face of the combustible heat source. Alternatively, the first barrier coating may be cut or otherwise machined after it is applied to the rear face of the combustible heat source. In one preferred embodiment, aluminium foil is applied to the rear face of the combustible heat source by gluing or pressing it to the combustible heat source, and is cut or otherwise machined so that the aluminium foil covers and adheres to at least substantially the entire rear face of the combustible heat source, preferably to the entire rear face of the combustible heat source.

In another preferred embodiment, the first barrier coating is formed by applying a solution or suspension of one or more suitable coating materials to the rear face of the combustible heat source. For example, the first barrier coating may be applied to the rear face of the combustible heat source by dipping the rear face of the combustible heat source in a solution or suspension of one or more suitable coating materials or by brushing or spray-coating a solution or suspension or electrostatically depositing a powder or powder mixture of one or more suitable coating materials onto the rear face of the combustible heat source. Where the first barrier coating is applied to the rear face of the combustible heat source by electrostatically depositing a powder or powder mixture of one or more suitable coating materials onto the rear face of the combustible heat source, the rear face of the combustible heat source is preferably pre-treated with water glass before electrostatic deposition. Preferably, the first barrier coating is applied by spray-coating.

The first barrier coating may be formed through a single application of a solution or suspension of one or more suitable coating materials to the rear face of the combustible heat source. Alternatively, the first barrier coating may be formed through multiple applications of a solution or suspension of one or more suitable coating materials to the rear face of the combustible heat source. For example, the first barrier coating may be formed through one, two, three, four, five, six, seven or eight successive applications of a solution or suspension of one or more suitable coating materials to the rear face of the combustible heat source.

Preferably, the first barrier coating is formed through between one and ten applications of a solution or suspension of one or more suitable coating materials to the rear face of the combustible heat source.

After application of the solution or suspension of one or more coating materials to the rear face thereof, the combustible heat source may be dried to form the first barrier coating.

Where the first barrier coating is formed through multiple applications of a solution or suspension of one or more suitable coating materials to the rear face thereof, the combustible heat source may need to be dried between successive applications of the solution or suspension.

Alternatively or in addition to drying, after application of a solution or suspension of one or more coating materials to the rear face of the combustible heat source, the coating material on the combustible heat source may be sintered in order to form the first barrier coating. Sintering of the first barrier coating is particularly preferred where the first barrier coating is a glass or ceramic coating. Preferably, the first barrier coating is sintered at a temperature of between about 500° C. and about 900° C., and more preferably at about 700° C.

Smoking articles according to the invention may comprise a non-blind combustible heat source. As used herein, the term 'non-blind' is used to describe a combustible heat source including at least one airflow channel extending from the front face to the rear face of the combustible heat source.

As used herein, the term 'airflow channel' is used to describe a channel extending along the length of a combustible heat source through which air may be drawn downstream for inhalation by a user.

In smoking articles according to the invention comprising a non-blind combustible heat source heating of the aerosol-forming substrate occurs by conduction and forced convection.

The one or more airflow channels may comprise one or more enclosed airflow channels.

As used herein, the term 'enclosed' is used to describe airflow channels that extend through the interior of the non-blind combustible heat source and are surrounded by the non-blind combustible heat source.

Alternatively or in addition, the one or more airflow channels may comprise one or more non-enclosed airflow channels. For example, the one or more airflow channels may comprise one or more grooves or other non-enclosed airflow channels that extend along the exterior of the non-blind combustible heat source.

The one or more airflow channels may comprise one or more enclosed airflow channels or one or more non-enclosed airflow channels or a combination thereof.

In certain embodiments, smoking articles according to the invention comprise one, two or three airflow channels extending from the front face to the rear face of the non-blind combustible heat source.

In certain preferred embodiments, smoking articles according to the invention comprise a single airflow channel extending from the front face to the rear face of the non-blind combustible heat source.

In certain particularly preferred embodiments, smoking articles according to the invention comprise comprises a single substantially central or axial airflow channel extending from the front face to the rear face of the non-blind combustible heat source.

In such embodiments, the diameter of the single airflow channel is preferably between about 1.5 mm and about 3 mm.

It will be appreciated that in addition to one or more airflow channels through which air may be drawn for inhalation by a user, smoking articles according to the invention may comprise non-blind combustible heat sources comprising one or more closed or blocked passageways through which air may not be drawn for inhalation by a user.

For example, smoking articles according to the invention may comprise non-blind combustible heat sources comprising one or more airflow channels extending from the front face to the rear face of the combustible heat source and one or more closed passageways that extend from the front face of the non-blind combustible heat source only part way along the length combustible heat source.

The inclusion of one or more closed air passageways increases the surface area of the non-blind combustible heat source that is exposed to oxygen from the air and may advantageously facilitate ignition and sustained combustion of the non-blind combustible heat source.

Where smoking articles according to the invention comprise a non-blind combustible heat source and a non-combustible, substantially air impermeable first barrier between the rear face of the combustible heat source and the aerosol-forming substrate, the first barrier should allow air entering the smoking article through the one or more airflow channels to be drawn downstream through the smoking article.

Alternatively or in addition to a non-combustible, substantially air impermeable first barrier between the rear face of the combustible heat source and the aerosol-forming substrate, smoking articles according to the invention comprising a non-blind combustible heat source may comprise a non-combustible substantially air impermeable second barrier between the non-blind combustible heat source and the one or more airflow channels.

The second barrier may advantageously substantially prevent or inhibit combustion and decomposition products formed during ignition and combustion of the non-blind combustible heat source from entering air drawn into smoking articles according to the invention through the one or more airflow channels as the drawn air passes through the one or more airflow channels. This is particularly advantageous where the non-blind combustible heat source comprises one or more additives to aid ignition or combustion of the non-blind combustible heat source.

Inclusion of a non-combustible substantially air impermeable second barrier between the non-blind combustible heat source and the one or more airflow channels may also advantageously substantially prevent or inhibit activation of combustion of the non-blind combustible heat source during puffing by a user. This may substantially prevent or inhibit spikes in the temperature of the aerosol-forming substrate during puffing by a user.

By preventing or inhibiting activation of combustion of the non-blind combustible heat source, and so preventing or inhibiting excess temperature increases in the aerosol-forming substrate, combustion or pyrolysis of the aerosol-forming substrate under intense puffing regimes may be advantageously avoided. In addition, the impact of a user's puffing regime on the composition of the mainstream aerosol may be advantageously minimised or reduced.

The second barrier may be adhered or otherwise affixed to the non-blind combustible heat source.

In certain preferred embodiments, the second barrier comprises a non-combustible substantially air impermeable second barrier coating provided on an inner surface of the one or more airflow channels. In such embodiments, preferably the second barrier comprises a second barrier coating provided on at least substantially the entire inner surface of the one or more airflow channels. More preferably, the second barrier comprises a second barrier coating provided on the entire inner surface of the one or more airflow channels.

In other embodiments, the second barrier coating may be provided by insertion of a liner into the one or more airflow channels. For example, where the one or more airflow channels comprise one or more enclosed airflow channels that extend through the interior of the non-blind combustible heat source, a non-combustible substantially air impermeable hollow tube may be inserted into each of the one or more airflow channels.

Depending upon the desired characteristics and performance of the smoking article, the second barrier may have a low thermal conductivity or a high thermal conductivity. Preferably, the second barrier has a low thermal conductivity.

The thickness of the second barrier may be appropriately adjusted to achieve good smoking performance. In certain embodiments, the second barrier may have a thickness of between about 30 microns and about 200 microns. In a preferred embodiment, the second barrier has a thickness of between about 30 microns and about 100 microns.

The second barrier may be formed from one or more suitable materials that are substantially thermally stable and non-combustible at temperatures achieved by the non-blind combustible heat source during ignition and combustion. Suitable materials are known in the art and include, but are not limited to, for example: clays; metal oxides, such as iron oxide, alumina, titania, silica, silica-alumina, zirconia and ceria; zeolites; zirconium phosphate; and other ceramic materials or combinations thereof.

Preferred materials from which the second barrier may be formed include clays, glasses, aluminium, iron oxide and combinations thereof. If desired, catalytic ingredients, such as ingredients that promote the oxidation of carbon monoxide to carbon dioxide, may be incorporated in the second barrier. Suitable catalytic ingredients include, but are not limited to, for example, platinum, palladium, transition metals and their oxides.

Where the second barrier comprises a second barrier coating provided on an inner surface of the one or more airflow channels, the second barrier coating may be applied to the inner surface of the one or more airflow channels by any suitable method, such as the methods described in U.S. Pat. No. 5,040,551. For example, the inner surface of the one or more airflow channels may be sprayed, wetted or painted with a solution or a suspension of the second barrier coating. In certain preferred embodiments, the second barrier coating is applied to the inner surface of the one or more airflow channels by the process described in WO-A2-2009/074870 as the combustible heat source is extruded.

Alternatively, smoking articles according to the invention may comprise a blind combustible heat source. As used herein, the term 'blind' is used to describe a combustible heat source that does not include any airflow channels extending from the front face to the rear face of the combustible heat source.

In use, the air drawn through smoking articles according to the invention comprising a blind combustible heat source for inhalation by a user does not pass through any airflow channels along the blind combustible heat source. The lack of any airflow channels through the blind combustible heat source advantageously substantially prevents or inhibits activation of combustion of the blind combustible heat source during puffing by a user. This substantially prevents or inhibits spikes in the temperature of the aerosol-forming substrate during puffing by a user.

By preventing or inhibiting activation of combustion of the blind combustible heat source, and so preventing or inhibiting excess temperature increases in the aerosol-forming substrate, combustion or pyrolysis of the aerosol-forming substrate under intense puffing regimes may be advantageously avoided. In addition, the impact of a user's puffing regime on the composition of the mainstream aerosol may be advantageously minimised or reduced.

The inclusion of a blind combustible heat source may also advantageously substantially prevent or inhibit combustion and decomposition products and other materials formed during ignition and combustion of the blind combustible heat source from entering air drawn through smoking articles according to the invention during use thereof. This is particularly advantageous where the blind combustible heat source comprises one or more additives to aid ignition or combustion of the blind combustible heat source.

In smoking articles according to the invention comprising a blind combustible heat source, heat transfer from the blind combustible heat source to the aerosol-forming substrate occurs primarily by conduction and heating of the aerosol-forming substrate by forced convection is minimised or reduced. This may advantageously helps to minimise or reduce the impact of a user's puffing regime on the composition of the mainstream aerosol of smoking articles according to the invention.

In smoking articles according to the invention comprising a blind combustible heat source, it is particularly important to optimise the conductive heat transfer between the combustible heat source and the aerosol-forming substrate. The inclusion of a second heat-conducting element has been found to have a particularly advantageous effect on the smoking performance of smoking articles including blind heat sources, where there is little if any heating of the aerosol-forming substrate by forced convection.

It will be appreciated that smoking articles according to the invention may comprise blind combustible heat sources comprising one or more closed or blocked passageways through which air may not be drawn for inhalation by a user.

For example, smoking articles according to the invention may comprise blind combustible heat sources comprising one or more closed passageways that extend from the front face at the upstream end of the blind combustible heat source only part way along the length of the blind combustible heat source.

The inclusion of one or more closed air passageways increases the surface area of the blind combustible heat source that is exposed to oxygen from the air and may advantageously facilitate ignition and sustained combustion of the blind combustible heat source.

Preferably, the combustible heat source is a carbonaceous heat source. As used herein, the term 'carbonaceous' is used to describe a combustible heat source comprising carbon. Preferably, combustible carbonaceous heat sources for use in smoking articles according to the invention have a carbon content of at least about 35 percent, more preferably of at least about 40 percent, most preferably of at least about 45 percent by dry weight of the combustible heat source.

In some embodiments, combustible heat sources according to the invention are combustible carbon-based heat sources. As used herein, the term 'carbon-based heat source' is used to describe a heat source comprised primarily of carbon.

Combustible carbon-based heat sources for use in smoking articles according to the invention have a carbon content of at least about 50 percent. For example, combustible carbon-based heat sources for use in smoking articles according to the invention may have a carbon content of at least about 60 percent, or at least about 70 percent, or at least about 80 percent by dry weight of the combustible carbon-based heat source.

Smoking articles according to the invention may comprise combustible carbonaceous heat sources formed from one or more suitable carbon-containing materials.

If desired, one or more binders may be combined with the one or more carbon-containing materials. Preferably, the one or more binders are organic binders. Suitable known organic binders, include but are not limited to, gums (for example, guar gum), modified celluloses and cellulose derivatives (for example, methyl cellulose, carboxymethyl cellulose, hydroxypropyl cellulose and hydroxypropyl methylcellulose) flour, starches, sugars, vegetable oils and combinations thereof.

In one preferred embodiment, the combustible heat source is formed from a mixture of carbon powder, modified cellulose, flour and sugar.

Instead of, or in addition to one or more binders, combustible heat sources for use in smoking articles according to the invention may comprise one or more additives in order to improve the properties of the combustible heat source. Suitable additives include, but are not limited to, additives to promote consolidation of the combustible heat source (for example, sintering aids), additives to promote ignition of the combustible heat source (for example, oxidisers such as perchlorates, chlorates, nitrates, peroxides, permanganates, zirconium and combinations thereof), additives to promote combustion of the combustible heat source (for example, potassium and potassium salts, such as potassium citrate) and additives to promote decomposition of one or more gases produced by combustion of the combustible heat source (for example catalysts, such as CuO, $Fe_2O_3$ and $Al_2O_3$).

Where smoking articles according to the invention comprise a first barrier coating provided on the rear face of the combustible heat source, such additives may be incorporated in the combustible heat source prior to or after application of the first barrier coating to the rear face of the combustible heat source.

In certain preferred embodiments, the combustible heat source is a combustible carbonaceous heat source comprising carbon and at least one ignition aid. In one preferred embodiment, the combustible heat source is a combustible carbonaceous heat source comprising carbon and at least one ignition aid as described in WO-A1-2012/164077.

As used herein, the term 'ignition aid' is used to denote a material that releases one or both of energy and oxygen during ignition of the combustible heat source, where the rate of release of one or both of energy and oxygen by the material is not ambient oxygen diffusion limited. In other words, the rate of release of one or both of energy and oxygen by the material during ignition of the combustible heat source is largely independent of the rate at which ambient oxygen can reach the material. As used herein, the term 'ignition aid' is also used to denote an elemental metal that releases energy during ignition of the combustible heat source, wherein the ignition temperature of the elemental metal is below about 500° C. and the heat of combustion of the elemental metal is at least about 5 kJ/g.

As used herein, the term 'ignition aid' does not include alkali metal salts of carboxylic acids (such as alkali metal citrate salts, alkali metal acetate salts and alkali metal succinate salts), alkali metal halide salts (such as alkali metal chloride salts), alkali metal carbonate salts or alkali metal phosphate salts, which are believed to modify carbon combustion. Even when present in a large amount relative to the total weight of the combustible heat source, such alkali metal burn salts do not release enough energy during ignition of a combustible heat source to produce an acceptable aerosol during early puffs.

Examples of suitable oxidizing agents include, but are not limited to: nitrates such as, for example, potassium nitrate, calcium nitrate, strontium nitrate, sodium nitrate, barium nitrate, lithium nitrate, aluminium nitrate and iron nitrate; nitrites; other organic and inorganic nitro compounds; chlorates such as, for example, sodium chlorate and potassium chlorate; perchlorates such as, for example, sodium perchlorate; chlorites; bromates such as, for example, sodium bromate and potassium bromate; perbromates; bromites; borates such as, for example, sodium borate and potassium borate; ferrates such as, for example, barium ferrate; ferrites; manganates such as, for example, potassium manganate; permanganates such as, for example, potassium permanganate; organic peroxides such as, for example, benzoyl peroxide and acetone peroxide; inorganic peroxides such as, for example, hydrogen peroxide, strontium peroxide, magnesium peroxide, calcium peroxide, barium peroxide, zinc peroxide and lithium peroxide; superoxides such as, for example, potassium superoxide and sodium superoxide; iodates; periodates; iodites; sulphates; sulfites; other sulfoxides; phosphates; phospinates; phosphites; and phosphanites.

While advantageously improving the ignition and combustion properties of the combustible heat source, the inclusion of ignition and combustion additives can give rise to undesirable decomposition and reaction products during use of the smoking article. For example, decomposition of nitrates included in the combustible heat source to aid ignition thereof can result in the formation of nitrogen oxides.

The inclusion of a non-combustible substantially air impermeable first barrier between the rear face of the combustible heat source and the aerosol-forming substrate may advantageously substantially prevent or inhibit such decomposition and reaction products from entering air drawn through smoking articles according to the invention.

Where smoking articles according to the invention comprise a non-blind combustible heat source, the inclusion of a non-combustible substantially air impermeable second barrier between the one or more airflow channels and the non-blind combustible heat source may advantageously substantially prevent or inhibit such decomposition and reaction products from entering air drawn into smoking articles according to the invention through the one or more airflow channels as the drawn air passes through the one or more airflow channels.

Combustible carbonaceous heat sources for use in smoking articles according to the invention may be prepared as described in prior art that is known to persons of ordinary skill in the art.

Combustible carbonaceous heat sources for use in smoking articles according to the invention, are preferably formed by mixing one or more carbon-containing materials with one or more binders and other additives, where included, and pre-forming the mixture into a desired shape. The mixture of one or more carbon containing materials, one or more binders and optional other additives may be pre-formed into a desired shape using any suitable known ceramic forming methods such as, for example, slip casting, extrusion, injection moulding and die compaction or pressing. In certain preferred embodiments, the mixture is pre-formed into a desired shape by pressing or extrusion or a combination thereof.

Preferably, the mixture of one or more carbon-containing materials, one or more binders and other additives is pre-formed into an elongate rod. However, it will be appreciated that the mixture of one or more carbon-containing materials, one or more binders and other additives may be pre-formed into other desired shapes.

After formation, particularly after extrusion, the elongate rod or other desired shape is preferably dried to reduce its moisture content and then pyrolysed in a non-oxidizing atmosphere at a temperature sufficient to carbonise the one or more binders, where present, and substantially eliminate any volatiles in the elongate rod or other shape. The elongate rod or other desired shape is pyrolysed preferably in a nitrogen atmosphere at a temperature of between about 700° C. and about 900° C.

In certain embodiments, at least one metal nitrate salt is incorporated in the combustible heat source by including at least one metal nitrate precursor in the mixture of one or more carbon containing materials, one or more binders and other additives. The at least one metal nitrate precursor is then subsequently converted in-situ into at least one metal nitrate salt by treating the pyrolysed pre-formed cylindrical rod or other shape with an aqueous solution of nitric acid. In one embodiment, the combustible heat source comprises at least one metal nitrate salt having a thermal decomposition temperature of less than about 600° C., more preferably of less than about 400° C. Preferably, the at least one metal nitrate salt has a decomposition temperature of between about 150° C. and about 600° C., more preferably of between about 200° C. and about 400° C.

In preferred embodiments, exposure of the combustible heat source to a conventional yellow flame lighter or other ignition means should cause the at least one metal nitrate salt to decompose and release oxygen and energy. This decomposition causes an initial boost in the temperature of the combustible heat source and also aids in the ignition of the combustible heat source. After decomposition of the at least one metal nitrate salt, the combustible heat source preferably continues to combust at a lower temperature.

The inclusion of at least one metal nitrate salt advantageously results in ignition of the combustible heat source being initiated internally, and not only at a point on the surface thereof. Preferably, the at least one metal nitrate salt is present in the combustible heat source in an amount of between about 20 percent by dry weight and about 50 percent by dry weight of the combustible heat source.

In other embodiments, the combustible heat source comprises at least one peroxide or superoxide that actively evolves oxygen at a temperature of less than about 600° C., more preferably at a temperature of less than about 400° C.

Preferably, the at least one peroxide or superoxide actively evolves oxygen at a temperature of between about 150° C. and about 600° C., more preferably at a temperature of between about 200° C. and about 400° C., most preferably at a temperature of about 350° C.

In use, exposure of the combustible heat source to a conventional yellow flame lighter or other ignition means should cause the at least one peroxide or superoxide to decompose and release oxygen. This causes an initial boost in the temperature of the combustible heat source and also aids in the ignition of the combustible heat source. After decomposition of the at least one peroxide or superoxide, the combustible heat source preferably continues to combust at a lower temperature.

The inclusion of at least one peroxide or superoxide advantageously results in ignition of the combustible heat source being initiated internally, and not only at a point on the surface thereof.

The combustible heat source preferably has a porosity of between about 20 percent and about 80 percent, more preferably of between about 20 percent and 60 percent. Where the combustible heat source comprises at least one metal nitrate salt, this advantageously allows oxygen to diffuse into the mass of the combustible heat source at a rate sufficient to sustain combustion as the at least one metal nitrate salt decomposes and combustion proceeds. Even more preferably, the combustible heat source has a porosity of between about 50 percent and about 70 percent, more preferably of between about 50 percent and about 60 percent as measured by, for example, mercury porosimetry or helium pycnometry. The required porosity may be readily achieved during production of the combustible heat source using conventional methods and technology.

Advantageously, combustible carbonaceous heat sources for use in smoking articles according to the invention have an apparent density of between about 0.6 g/cm$^3$ and about 1 g/cm$^3$.

Preferably, the combustible heat source has a mass of between about 300 mg and about 500 mg, more preferably of between about 400 mg and about 450 mg.

Preferably, the combustible heat source has a length of between about 7 mm and about 17 mm, more preferably of between about 7 mm and about 15 mm, most preferably of between about 7 mm and about 13 mm.

Preferably, the combustible heat source has a diameter of between about 5 mm and about 9 mm, more preferably of between about 7 mm and about 8 mm.

Preferably, the combustible heat source is of substantially uniform diameter. However, the combustible heat source may alternatively be tapered so that the diameter of a rear portion of the blind combustible heat source is greater than the diameter of a front portion thereof. Particularly preferred are combustible heat sources that are substantially cylindrical. The combustible heat source may, for example, be a cylinder or tapered cylinder of substantially circular cross-section or a cylinder or tapered cylinder of substantially elliptical cross-section.

Smoking articles according to the invention preferably comprise an aerosol-forming substrate comprising at least one aerosol-former and a material capable of releasing volatile compounds in response to heating. The aerosol-forming substrate may comprise other additives and ingredients including, but not limited to, humectants, flavourants, binders and mixtures thereof.

Preferably, the aerosol-forming substrate comprises nicotine. More preferably, the aerosol-forming substrate comprises tobacco.

The at least one aerosol-former may be any suitable known compound or mixture of compounds that, in use, facilitates formation of a dense and stable aerosol and that is substantially resistant to thermal degradation at the operating temperature of the smoking article. Suitable aerosol-formers are well known in the art and include, for example, polyhydric alcohols, esters of polyhydric alcohols, such as glycerol mono-, di- or triacetate, and aliphatic esters of mono-, di- or polycarboxylic acids, such as dimethyl dodecanedioate and dimethyl tetradecanedioate. Preferred aerosol formers for use in smoking articles according to the invention are polyhydric alcohols or mixtures thereof, such as triethylene glycol, 1,3-butanediol and, most preferred, glycerine.

The material capable of emitting volatile compounds in response to heating may be a charge of plant-based material. The material capable of emitting volatile compounds in response to heating may be a charge of homogenised plant-based material. For example, the aerosol-forming substrate may comprise one or more materials derived from plants including, but not limited to: tobacco; tea, for example green tea; peppermint; laurel; eucalyptus; basil; sage; verbena; and tarragon.

Preferably, the material capable of emitting volatile compounds in response to heating is a charge of tobacco-based material, most preferably a charge of homogenised tobacco-based material.

The aerosol-forming substrate may be in the form of a plug or segment comprising a material capable of emitting volatile compounds in response to heating circumscribed by a paper or other wrapper. As stated above, where an aerosol-forming substrate is in the form of such a plug or segment, the entire plug or segment including any wrapper is considered to be the aerosol-forming substrate.

Preferably, the aerosol-forming substrate has a length of between about 5 mm and about 20 mm, more preferably of between about 8 mm and about 12 mm.

In preferred embodiments, the aerosol-forming substrate comprises a plug of tobacco-based material wrapped in a plug wrap. In particular preferred embodiments, the aerosol-forming substrate comprises a plug of homogenised tobacco-based material wrapped in a plug wrap.

Smoking articles according to the invention preferably comprise a mouthpiece downstream of the aerosol-forming substrate. The mouthpiece is located at the proximal end of the smoking article.

Preferably, the mouthpiece is of low filtration efficiency, more preferably of very low filtration efficiency. The mouthpiece may be a single segment or component mouthpiece. Alternatively, the mouthpiece may be a multi-segment or multi-component mouthpiece.

The mouthpiece may comprise a filter comprising one or more segments comprising suitable known filtration materials. Suitable filtration materials are known in the art and include, but are not limited to, cellulose acetate and paper. Alternatively or in addition, the mouthpiece may comprise one or more segments comprising absorbents, adsorbents, flavourants, and other aerosol modifiers and additives or combinations thereof.

Smoking articles according to the invention preferably further comprise a transfer element or spacer element between the aerosol-forming substrate and the mouthpiece.

The transfer element may abut one or both of the aerosol-forming substrate and the mouthpiece. Alternatively, the transfer element may be spaced apart from one or both of the aerosol-forming substrate and the mouthpiece.

The inclusion of a transfer element advantageously allows cooling of the aerosol generated by heat transfer from the combustible heat source to the aerosol-forming substrate. The inclusion of a transfer element also advantageously allows the overall length of smoking articles according to the invention to be adjusted to a desired value, for example to a length similar to that of conventional cigarettes, through an appropriate choice of the length of the transfer element.

The transfer element may have a length of between about 7 mm and about 50 mm, for example a length of between about 10 mm and about 45 mm or of between about 15 mm and about 30 mm. The transfer element may have other lengths depending upon the desired overall length of the smoking article, and the presence and length of other components within the smoking article.

Preferably, the transfer element comprises at least one open-ended tubular hollow body. In such embodiments, in use, the air drawn through the smoking article passes through the at least one open-ended tubular hollow body as it passes downstream through the smoking article from the aerosol-forming substrate to the proximal end thereof.

The transfer element may comprise at least one open-ended tubular hollow body formed from one or more suitable materials that are substantially thermally stable at the temperature of the aerosol generated by the transfer of heat from the combustible heat source to the aerosol-forming substrate. Suitable materials are known in the art and include, but are not limited to, paper, cardboard, plastics, such a cellulose acetate, ceramics and combinations thereof.

Alternatively or in addition, smoking articles according to the invention may comprise an aerosol-cooling element or heat exchanger between the aerosol-forming substrate and the mouthpiece. The aerosol-cooling element may comprise a plurality of longitudinally extending channels.

The aerosol-cooling element may comprise a gathered sheet of material selected from the group consisting of metallic foil, polymeric material, and substantially non-porous paper or cardboard. In certain embodiments, the aerosol-cooling element may comprise a gathered sheet of material selected from the group consisting of polyethylene (PE), polypropylene (PP), polyvinylchloride (PVC), polyethylene terephthalate (PET), polylactic acid (PLA), cellulose acetate (CA), and aluminium foil.

In certain preferred embodiments, the aerosol-cooling element may comprise a gathered sheet of biodegradable polymeric material, such as polylactic acid (PLA) or a grade of Mater-Bi® (a commercially available family of starch based copolyesters).

Smoking articles according to the invention may comprise one or more aerosol modifying agents downstream of the aerosol-forming substrate. For example, one or more of the mouthpiece, transfer element and aerosol-cooling element of smoking articles according to the invention may comprise one or more aerosol modifying agents.

Suitable aerosol-modifying agents include, but are not limited to: flavourants; and chemesthetic agents.

As used herein, the term 'flavourant' is used to describe any agent that, in use, imparts one or both of a taste or aroma to an aerosol generated by the aerosol-forming substrate of the smoking article.

As used herein, the term 'chemesthetic agent' is used to describe any agent that, in use, is perceived in the oral or olfactory cavities of a user by means other than, or in addition to, perception via taste receptor or olfactory receptor cells. Perception of chemesthetic agents is typically via a "trigeminal response," either via the trigeminal nerve, glossopharyngeal nerve, the vagus nerve, or some combination of these. Typically, chemesthetic agents are perceived as hot, spicy, cooling, or soothing sensations.

Smoking articles according to the invention may comprise one or more aerosol modifying agents that are both a flavourant and a chemesthetic agent downstream of the aerosol-forming substrate. For example, one or more of the mouthpiece, transfer element and aerosol-cooling element of smoking articles according to the invention may comprise menthol or another flavourant that provides a cooling chemesthetic effect.

Smoking articles according to the invention may be assembled using known methods and machinery.

Figure 2:
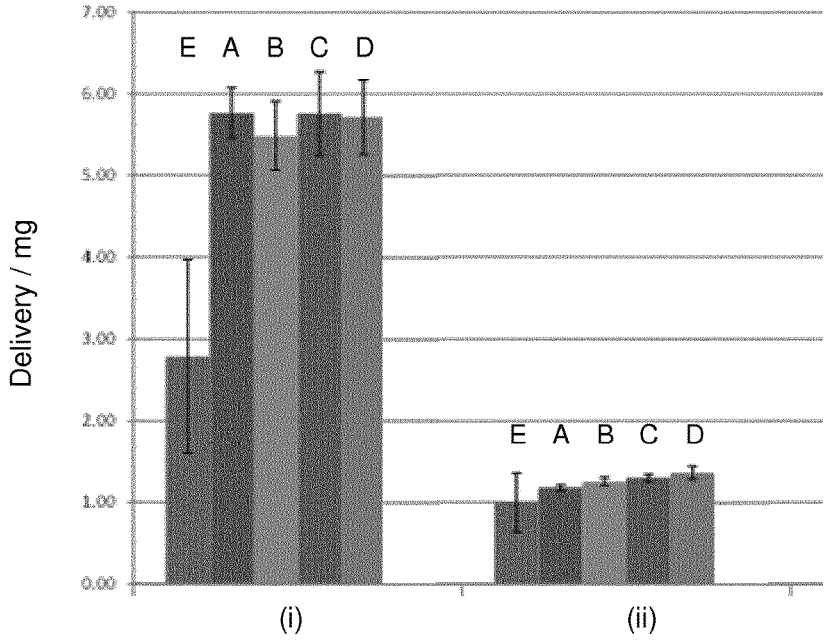

The invention will be further described, by way of example only, with reference to the accompanying drawings in which:

FIG. 1 shows a schematic longitudinal cross-section of a smoking article according to an embodiment of the invention; and FIG. 2 shows a graph of total aerosol-former and nicotine deliveries for smoking articles according to the embodiment of the invention shown in FIG. 1.

The smoking article 2 according to the first embodiment of the invention shown in FIG. 1 comprises a blind combustible heat source 4 having a front face 6 and an opposed rear face 8, an aerosol-forming substrate 10, a transfer element 12, an aerosol-cooling element 14, a spacer element 16 and a mouthpiece 18 in abutting coaxial alignment. As shown in FIG. 1, the aerosol-forming substrate 10, transfer element 12, aerosol-cooling element 14, spacer element 16 and mouthpiece 18 and a rear portion of the blind combustible heat source 4 are wrapped in an outer wrapper 20 of sheet material such as, for example, cigarette paper, of low air permeability. It will be appreciated that in other embodiments of the invention (not shown), the outer wrapper 20 may be omitted.

The blind combustible heat source 4 is a blind carbonaceous combustible heat source and is located at the distal end of the smoking article 2. As shown in FIG. 1, a non-combustible substantially air impermeable first barrier 22 in the form of a disc of aluminium foil is provided between the rear face 8 of the blind combustible heat source 4 and the aerosol-forming substrate 10. The first barrier 22 is applied to the rear face 8 of the blind combustible heat source 4 by pressing the disc of aluminium foil onto the rear face 8 of the blind combustible heat source 4 and abuts the rear face 8 of the combustible carbonaceous heat source 4 and the aerosol-forming substrate 10.

The aerosol-forming substrate 10 is located immediately downstream of the first barrier 22 applied to the rear face 8 of the blind combustible heat source 4. The aerosol-forming substrate 10 comprises a cylindrical plug of homogenised tobacco-based material 24 including an aerosol former such as, for example, glycerine, wrapped in plug wrap 26.

The transfer element 12 is located immediately downstream of the aerosol-forming substrate 10 and comprises a cylindrical open-ended hollow cellulose acetate tube 28.

The aerosol-cooling element 14 is located immediately downstream of the transfer element 12 and comprises a gathered sheet of biodegradable polymeric material such as, for example, polylactic acid.

The spacer element 16 is located immediately downstream of the aerosol-cooling element 14 and comprises a cylindrical open-ended hollow paper or cardboard tube 30.

The mouthpiece 18 is located immediately downstream of the spacer element 16. As shown in FIG. 1, the mouthpiece 18 is located at the proximal end of the smoking article 2 and comprises a cylindrical plug of suitable filtration material 32 such as, for example, cellulose acetate tow of very low filtration efficiency, wrapped in filter plug wrap 34.

The smoking article may further comprise a band of tipping paper (not shown) circumscribing a downstream end portion of the outer wrapper 20.

As shown in FIG. 1, the smoking article 2 further comprises a first heat-conducting element 36 of suitable material such as, for example, aluminium foil, around and in direct contact with a rear portion 4*b* of the blind combustible heat source 4 and a front portion 10*a* of the aerosol-forming substrate 10. In the smoking article 2 according to the first embodiment of the invention shown in FIG. 1, the aerosol-forming substrate 10 extends downstream beyond the first heat-conducting element 36. That is, the first heat-conducting element 36 is not around and in direct contact with a rear portion of the aerosol-forming substrate 10. However, it will be appreciated that in other embodiments of the invention (not shown), the first heat-conducting element 36 may be around and in contact with the entire length of the aerosol-forming substrate 10.

As shown in FIG. 1, the smoking article 2 also further comprises a second heat-conducting element 38 around a rear portion of the blind combustible heat source 4, the entire length of the aerosol-forming substrate 10 and the entire length of the transfer element 12. In the smoking article 2 according to the first embodiment of the invention shown in FIG. 1, the second heat-conducting element 34 extends to approximately the same position on the blind combustible heat source 4 as the first heat-conducting element 36 in the upstream direction, such that the upstream ends of the first heat-conducting element 36 and the second heat-conducting element 38 are substantially aligned over the blind combustible heat source 4. However, it will be appreciated that in other embodiments of the invention (not shown), the first heat-conducting element 36 may extend beyond the second heat-conducting element 38 in the upstream direction, such that the rear portion 4*b* of the blind combustible heat source circumscribed by the first heat-conducting element 36 is larger than the rear portion of the blind combustible heat source circumscribed by the second heat-conducting element 38.

The second heat-conducting element 38 is a double layer laminate material comprising an inner layer 38*a* of heat-insulative material such as, for example, paper and an outer layer 38*b* of heat-conductive material, such as, for example, aluminium. As shown in FIG. 1, the first heat-conducting element 36 and the outer layer 38*b* of heat-conductive material of the second heat-conducting element 38 are radially separated by the inner layer 38*a* of heat-insulative material of the second heat-conducting element 38, which is located between the first heat-conducting element 36 and the outer layer 38*b* of heat-conductive material of the second heat-conducting element 38.

The smoking article 2 according to the first embodiment of the invention comprises one or more first air inlets 40 around the periphery of the aerosol-forming substrate 10.

As shown in FIG. 1, a circumferential arrangement of first air inlets 40 is provided in the plug wrap 26 of the aerosol-forming substrate 10, the inner layer 38*a* of heat-insulative material and the outer layer 38*b* of heat-conductive material of the second heat conducting element 38, and the overlying outer wrapper 20 to admit cool air (shown by dotted arrows in FIG. 1) into the aerosol-forming substrate 10. It will be appreciated that in other embodiments of the invention (not shown) in which the first heat-conducting element 36 is around and in direct contact with the entire length of the aerosol-forming substrate 10, a circumferential arrangement of first air inlets 40 may be provided in the plug wrap 26 of the aerosol-forming substrate 10, the first heat-conducting element 36, the inner layer 38*a* of heat-insulative material and the outer layer 38*b* of heat-conductive material of the second heat conducting element 38, and the overlying outer wrapper 20 to admit cool air into the aerosol-forming substrate 10.

In use, a user ignites the blind combustible heat source 4 of the smoking article 2 according to the first embodiment of the invention and then draws on the mouthpiece 18. When a user draws on the mouthpiece 18, cool air (shown by dotted arrows in FIG. 1) is drawn into the aerosol-forming substrate 10 of the smoking article 2 through the first air inlets 40.

The front portion 10*a* of the aerosol-forming substrate 10 is heated by conduction through the rear face 8 of the blind combustible heat source 4 and the first barrier 22 and the first heat-conducting element 36.

The heating of the aerosol-forming substrate 10 by conduction releases glycerine and other volatile and semi-volatile compounds from the plug of homogenised tobacco-based material 24. The compounds released from the aerosol-forming substrate 10 form an aerosol that is entrained in the air drawn into the aerosol-forming substrate 10 of the smoking article 2 through the first air inlets 40 as it flows through the aerosol-forming substrate 10. The drawn air and entrained aerosol (shown by dashed arrows in FIGS. 1*a*) and 2) pass downstream through the interior of the cylindrical open-ended hollow cellulose acetate tube 28 of the transfer element 12, the aerosol-cooling element 14 and the spacer element 16, where they cool and condense. The cooled drawn air and entrained aerosol pass downstream through the mouthpiece 18 and are delivered to the user through the proximal end of the smoking article 2 according to the first embodiment of the invention. The non-combustible substantially air impermeable first barrier 22 on the rear face 8 of the blind combustible heat source 4 isolates the blind combustible heat source 4 from air drawn through the smoking article 2 such that, in use, air drawn through the smoking article 2 does not come into direct contact with the blind combustible heat source 4.

In use, the second heat-conducting element 38 retains heat within the smoking article 2 to help maintain the temperature of the first heat-conducting element 36 during smoking. This in turn helps maintain the temperature of the aerosol-forming substrate 10 to facilitate continued and enhanced aerosol delivery. In addition, the second heat-conducting element 38 transfers heat along the aerosol-forming substrate 10, beyond the downstream end of the first heat-conducting element 36 so that heat is dispersed through a larger volume of the aerosol-forming substrate 10. This helps to provide a more consistent puff-by-puff aerosol delivery.

EXAMPLES A-D

Smoking articles according to the first embodiment of the invention comprising a circumferential arrangement of first air inlets around the periphery of the aerosol-forming substrate are assembled having the dimensions shown in Table 1. The smoking articles are assembled without an outer wrapper, such that the outer layer of the second heat-conducting element is visible on the exterior of the smoking articles. The location of the circumferential arrangement of first air inlets around the periphery of the aerosol-forming substrate in the smoking articles is shown by the arrows labelled A, B, C and D, respectively, in FIG. 1.

COMPARATIVE EXAMPLE E

For the purposes of comparison, a smoking article not according to the invention is assembled having the dimensions shown in Table 1. The smoking article not according to the invention differs from the smoking articles according to the invention of Examples A-D in that it comprises a circumferential arrangement of third air inlets around the periphery of the cylindrical open-ended hollow cellulose acetate tube of the transfer element, rather than a circumferential arrangement of first air inlets around the periphery of the aerosol-forming substrate. The location of the circumferential arrangement of third air inlets around the periphery of the cylindrical open-ended hollow cellulose acetate tube of the transfer element is shown by the arrow labelled E in FIG. 1.

When a user draws on the mouthpiece of the smoking article not according to the invention, cool air is drawn into the cylindrical open-ended hollow cellulose acetate tube of the transfer element of the smoking article through the third air inlets. The drawn air passes upstream through the cellulose acetate of the cylindrical open-ended hollow cellulose acetate tube to the aerosol-forming substrate. The drawn air then passes downstream through the aerosol-forming substrate, the interior of the cylindrical open-ended hollow cellulose acetate tube of the transfer element, the aerosol-cooling element, the spacer element, and the mouthpiece and is delivered to the user through the proximal end of the smoking article.

TABLE 1

| Example | A | B | C | D | E |
|---|---|---|---|---|---|
| Overall length (mm) | | 79 | | | |
| Diameter (mm) | | 8 | | | |
| Blind combustible heat source | | | | | |
| Length (mm) | | 9 | | | |
| Diameter (mm) | | 7.78 | | | |
| Thickness of first barrier (microns) | | 20 | | | |
| Aerosol-forming substrate | | | | | |
| Length (mm) | | 8 | | | |
| Diameter (mm) | | 7.8 | | | |
| Density (g/cm$^3$) | | 0.54 | | | |
| Amount of aerosol former (glycerine) (% dry weight basis) | | 20 | | | |
| Transfer element | | | | | |
| Length (mm) | | 26 | | | |
| External diameter (mm) | | 7.85 | | | |
| Internal diameter (mm) | | 4 | | | |
| Cooling element | | | | | |
| Length (mm) | | 12 | | | |
| Spacer element | | | | | |
| Length (mm) | | 12 | | | |
| Mouthpiece | | | | | |
| Length (mm) | | 12 | | | |
| Diameter (mm) | | 7.95 | | | |
| Heat-conducting elements | | | | | |
| Length of first heat-conducting element (mm) | | 5 | | | |
| Thickness of first heat-conducting element (μm) | | 20 | | | |
| Distance of first heat-conducting element from front face of blind combustible heat source (mm) | | 6 | | | |
| Length of second heat-conducting element (mm) | | 37 | | | |
| Thickness of second heat-conducting element (μm) | | 6 | | | |
| Distance of second heat-conducting element from front face of blind combustible heat source (mm) | | 6 | | | |
| First air inlets | | | | | |
| Distance from front face of blind combustible heat source (mm) | 12 | 14 | 15 | 16 | — |
| Distance from upstream end of aerosol-forming substrate combustible heat source (mm) | 3 | 5 | 6 | 7 | — |
| Third air inlets | | | | | |
| Distance from front face of blind combustible heat source (mm) | — | — | — | — | 22 |
| Distance from upstream end of hollow cellulose acetate tube (mm) | — | — | — | — | 5 |

TABLE 1-continued

| Example | A | B | C | D | E |
|---|---|---|---|---|---|

The total glycerine and nicotine deliveries of the smoking articles according to the invention of Examples A-D and the smoking article not according to the invention of Comparative Example E are measured. The results are shown in FIG. 2 and Table 2. To measure the total glycerine and nicotine deliveries, the smoking articles are ignited using a conventional yellow flame lighter and smoked under a Health Canada smoking regime over 12 puffs with a puff volume of 55 ml, puff duration of 2 seconds and a puff interval of 30 seconds using a smoking machine. Conditions for smoking and smoking machine specifications are set out in ISO Standard 3308 (ISO 3308:2000). The atmosphere for conditioning and testing is set out in ISO Standard 3402.

During the smoking run, glycerine and nicotine in the mainstream aerosol are trapped on a fiberglass filter disc (Cambridge Pad). After the smoking run, glycerine and nicotine are extracted from the fiberglass filter disc using an alcohol solution. The solution is then assayed, with glycerine and nicotine being quantified, using a Gas Chromatography method.

As shown in FIG. 2 and Table 2, inclusion of one or more first air lets around the periphery of the aerosol-forming substrate increases the total glycerine and nicotine deliveries of the smoking articles according to the invention of Examples A-D compared to the smoking article not according to the invention of Comparative E in which one or more third air inlets are provided downstream of the aerosol-forming substrate.

TABLE 2

| | Delivery/mg | |
|---|---|---|
| Example | (i) Glycerine | (ii) Nicotine |
| A | 5.76 | 1.17 |
| B | 5.48 | 1.25 |
| C | 5.75 | 1.29 |
| D | 5.71 | 1.36 |
| E | 2.78 | 1.00 |

The specific embodiments described above are intended to illustrate the invention. However, other embodiments may be made without departing from the spirit and scope of the invention as defined in the claims, and it is to be understood that the specific embodiments described above are not intended to be limiting.

The invention claimed is:

1. A smoking article, comprising:

a combustible heat source having opposed front and rear faces, wherein the combustible heat source is a blind combustible heat source;

an aerosol-forming substrate downstream of the rear face of the combustible heat source;

a non-combustible substantially air impermeable barrier disposed between the rear face of the combustible heat source and the aerosol-forming substrate;

a mouthpiece downstream of the aerosol-forming substrate;

a transfer element between the aerosol-forming substrate and the mouthpiece;

a first heat-conducting element circumscribing a rear portion of the combustible heat source and at least a front portion of the aerosol-forming substrate;

a second heat-conducting element overlying at least a portion of the first heat-conducting element, wherein at least part of the second heat-conducting element is radially separated from the first heat-conducting element, and wherein the second heat-conducting element extends beyond the first heat-conducting element in a downstream direction and overlies an entire length of the aerosol-generating substrate and an entire length of the transfer element; and one or more first air inlets around a periphery of the aerosol-forming substrate and being configured to draw air therethrough into the aerosol-forming substrate in a radial direction.

2. The smoking article according to claim 1, wherein all of the second heat-conducting element is radially separated from the first heat-conducting element.

3. The smoking article according to claim 1, wherein the first heat-conducting element and the second heat-conducting element are radially separated by a heat-insulative material.

4. The smoking article according to claim 1, wherein the first heat-conducting element and the second heat-conducting element are radially separated by at least 50 microns.

5. The smoking article according to claim 1, wherein the second heat-conducting element overlies at least a portion of the combustible heat source.

6. The smoking article according to claim 1, further comprising an outer wrapper around the second heat-conducting element.

7. The smoking article according to claim 1, wherein the second heat-conducting element is disposed at an outside of the smoking article, such that the second-heat conducting element is visible on an external surface of the smoking article.

8. The smoking article according to claim 1, wherein the second heat-conducting element includes a laminate material comprising one or more layers of a heat-conductive material.

9. The smoking article according to claim 1, wherein the second heat-conducting element comprises one or more layers of a heat-reflective material.

10. The smoking article according to claim 9, wherein the heat-reflective material is configured to reflect more than 50% of incident radiation.

11. The smoking article according to claim 1, further comprising one or more second air inlets between the rear face of the combustible heat source and the aerosol-forming substrate.

12. The smoking article according to claim 1, further comprising one or more aerosol modifying agents downstream of the aerosol-forming substrate.

13. The smoking article according to claim 1, wherein the second heat-conducting element extends beyond the first heat-conducting element in a downstream direction and radially surrounds the transfer element.

14. A smoking article, comprising:

a combustible heat source having opposed front and rear faces, wherein the combustible heat source is a blind combustible heat source;

an aerosol-forming substrate downstream of the rear face of the combustible heat source;

a non-combustible substantially air impermeable barrier disposed between the rear face of the combustible heat source and the aerosol-forming substrate;

a mouthpiece downstream of the aerosol-forming substrate;

a transfer element between the aerosol-forming substrate and the mouthpiece;

a first heat-conducting element circumscribing a rear portion of the combustible heat source and at least a front portion of the aerosol-forming substrate;

a second heat-conducting element overlying at least a portion of the first heat-conducting element, wherein at least part of the second heat-conducting element is radially separated from the first heat-conducting element, and wherein the second heat-conducting element extends beyond the first heat-conducting element in a downstream direction and overlies an entire length of the aerosol-generating substrate and an entire length of the transfer element; and one or more first air inlets around a periphery of the aerosol-forming substrate, wherein the first heat-conducting element and the second heat-conducting element are radially separated by at least 20 microns.

15. A smoking article, comprising:

a combustible heat source having opposed front and rear faces, wherein the combustible heat source is a blind combustible heat source;

an aerosol-forming substrate downstream of the rear face of the combustible heat source;

a non-combustible substantially air impermeable barrier disposed between the rear face of the combustible heat source and the aerosol-forming substrate;

a mouthpiece downstream of the aerosol-forming substrate;

a transfer element between the aerosol-forming substrate and the mouthpiece;

a first heat-conducting element circumscribing a rear portion of the combustible heat source and at least a front portion of the aerosol-forming substrate;

a second heat-conducting element overlying at least a portion of the first heat-conducting element, wherein at least part of the second heat-conducting element is radially separated from the first heat-conducting element, and wherein the second heat-conducting element extends beyond the first heat-conducting element in a downstream direction and overlies an entire length of the aerosol-generating substrate and an entire length of the transfer element; and one or more first air inlets around a periphery of the aerosol-forming substrate, wherein the first heat-conducting element and the second heat-conducting element are radially separated by a heat-insulative material.

16. The smoking article according to claim 1, wherein the second heat-conducting element comprises steel.

17. The smoking article according to claim 1, wherein the one or more first air inlets are located proximate to the downstream end of the aerosol-forming substrate.

18. The smoking article according to claim 1, wherein the transfer element comprises at least one open-ended tubular hollow body.

* * * * *